US011053630B2

(12) United States Patent
Islas et al.

(10) Patent No.: US 11,053,630 B2
(45) Date of Patent: Jul. 6, 2021

(54) WASHING MACHINE APPLIANCE HAVING A VENTING SYSTEM

(71) Applicant: Haier US Appliance Solutions, Inc., Wilmington, DE (US)

(72) Inventors: Erick Flores Islas, Louisville, KY (US); Aaron Daniel Abbott, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 276 days.

(21) Appl. No.: 16/263,051

(22) Filed: Jan. 31, 2019

(65) Prior Publication Data

US 2020/0248386 A1 Aug. 6, 2020

(51) Int. Cl.

| | |
|---|---|
| ***D06F 39/14*** | (2006.01) |
| ***D06F 35/00*** | (2006.01) |
| ***D06F 25/00*** | (2006.01) |
| ***D06F 37/26*** | (2006.01) |

(52) U.S. Cl.

CPC ..... *D06F 39/14* (2013.01); *D06F 25/00* (2013.01); *D06F 35/00* (2013.01); *D06F 37/267* (2013.01)

(58) Field of Classification Search

CPC ..... D06F 39/14

See application file for complete search history.

(56) References Cited

U.S. PATENT DOCUMENTS

| | | | |
|---|---|---|---|
| 6,000,248 | A | 12/1999 | Erickson et al. |
| 7,810,360 | B2 | 10/2010 | Kim et al. |
| 8,020,412 | B2 | 9/2011 | Kim et al. |
| 2006/0059959 | A1 | 3/2006 | Je |
| 2008/0078209 | A1* | 4/2008 | Kim ..... D06F 58/203 68/4 |
| 2011/0041562 | A1 | 2/2011 | Balinski et al. |
| 2013/0192084 | A1 | 8/2013 | Hill et al. |

FOREIGN PATENT DOCUMENTS

| | | | |
|---|---|---|---|
| JP | 2018099171 | A | 6/2018 |
| KR | 20080030886 | A | 4/2008 |
| KR | 20140091563 | A | 7/2014 |
| RU | 2542546 | C2 | 2/2015 |

* cited by examiner

*Primary Examiner* — Jason Y Ko

(74) *Attorney, Agent, or Firm* — Dority & Manning, P.A.

(57) ABSTRACT

A washing machine appliance equipped with a venting system is provided. The venting system includes features for venting or expelling relatively humid air from a subwasher of the washing machine appliance, e.g., at the completion of a wash cycle. In one example aspect, a door of the washing machine appliance defines a plurality of vent apertures that allow for fresh air from an ambient environment to flow into an interior volume of the subwasher. The vent apertures extend through the door and fluidly connect the ambient environment with the interior volume. The relatively low humidity fresh air that flows into the interior chamber mixes with the relatively humid air within the interior volume. The mixed air is expelled from the washing machine appliance via a venting conduit.

20 Claims, 6 Drawing Sheets

WASHING MACHINE APPLIANCE HAVING A VENTING SYSTEM

FIELD OF THE INVENTION

The present subject matter relates generally to washing machine appliances, and more particularly to venting systems for front load or horizontal axis washing machine appliances.

BACKGROUND OF THE INVENTION

Washing machine appliances generally include a wash tub for containing water or wash fluid (e.g., water and detergent, bleach, or other wash additives). A drum or basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc.

In some instances, residual water remaining on a gasket and/or sump volume at the wash tub can produce mold and mildew, resulting in an undesirable odor. Over time, mold/mildew can buildup and generate black spots on articles, especially white clothes. Consumers find the buildup of mold and mildew and the odor emanating therefrom undesirable. Moreover, black spots generated on washed articles can be an inconvenience to consumers and can ruin the articles.

Accordingly, an improved washing machine appliance that addresses one or more of the challenges noted above would be desirable.

BRIEF DESCRIPTION OF THE INVENTION

Aspects and advantages of the invention will be set forth in part in the following description, or may be obvious from the description, or may be learned through practice of the invention.

In one aspect, a washing machine appliance is provided. The washing machine appliance includes a cabinet and a tub positioned within the cabinet and defining an interior volume. Further, the washing machine appliance includes a basket rotatably mounted within the tub, the basket defining a wash chamber for receipt of articles for washing. In addition, the washing machine appliance includes a door operatively coupled with the cabinet and movable between an open position and a closed position to provide selective access to the wash chamber, the door having a door frame defining a plurality of vent apertures that provide fluid communication between an ambient environment and the interior volume of the tub when the door is in the closed position.

In another aspect, a horizontal axis washing machine appliance is provided. The washing machine appliance includes a cabinet and a tub positioned within the cabinet and defining an interior volume. Further, the washing machine appliance includes a basket rotatably mounted within the tub, the basket defining a wash chamber for receipt of articles for washing. The washing machine appliance further includes a door operatively coupled with the cabinet and movable between an open position and a closed position to provide selective access to the wash chamber, the door having a door frame that has an upper portion and a lower portion, the door frame defining a recess and a plurality of vent apertures at the upper portion that extend through the door frame. In addition, the washing machine appliance includes a venting grill received within the recess and defining a plurality of grill apertures. The washing machine appliance also includes a venting conduit in fluid communication with the interior volume of the tub and an ambient environment. Moreover, when the door is in the closed position, the plurality of grill apertures provide fluid communication between the ambient environment and the plurality of vent apertures and the plurality of vent apertures provide fluid communication between the plurality of grill apertures and the interior volume of the tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
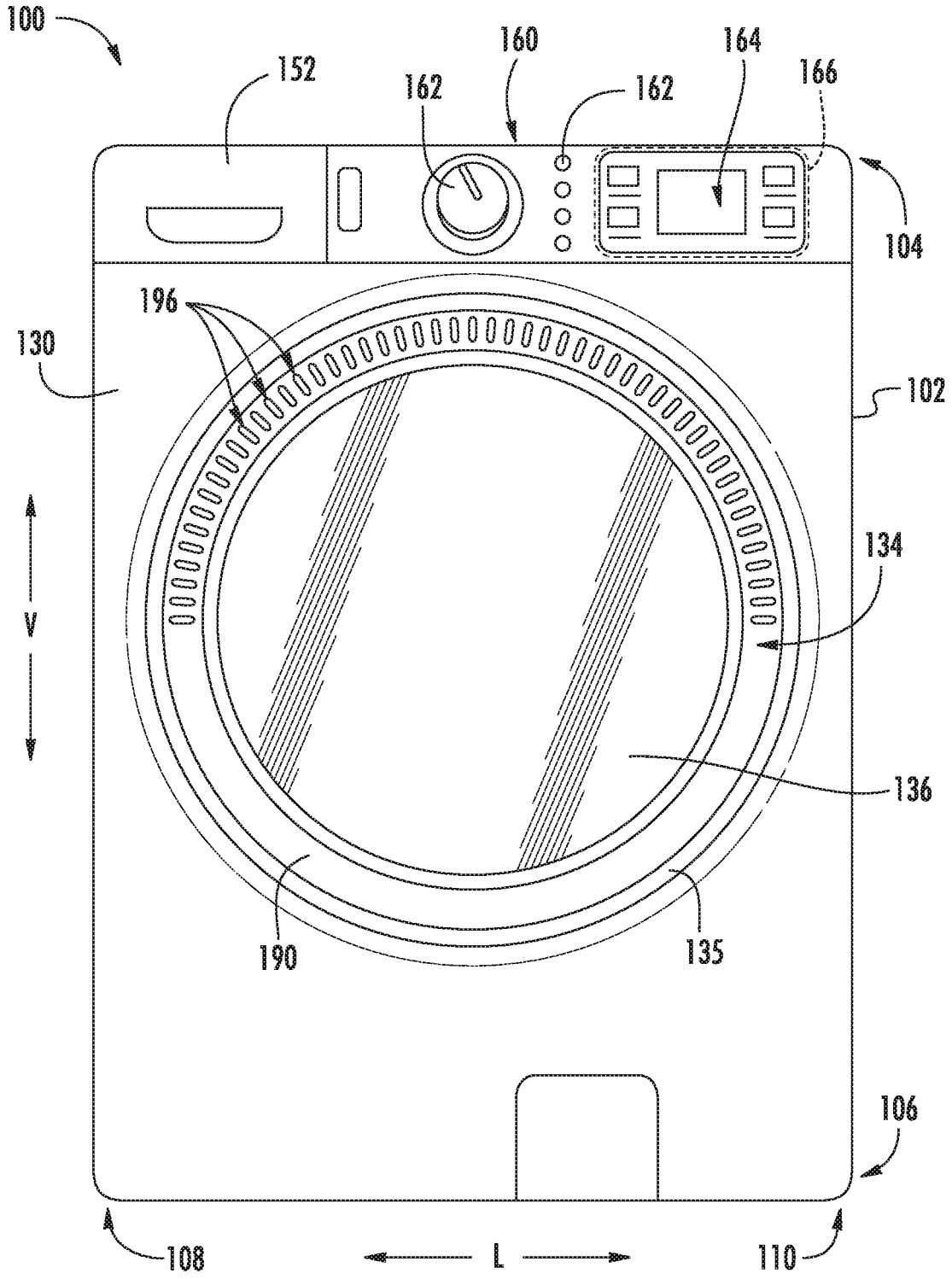
FIG. 1 provides a front view of a washing machine appliance according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of the present disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements.

Figure 2:
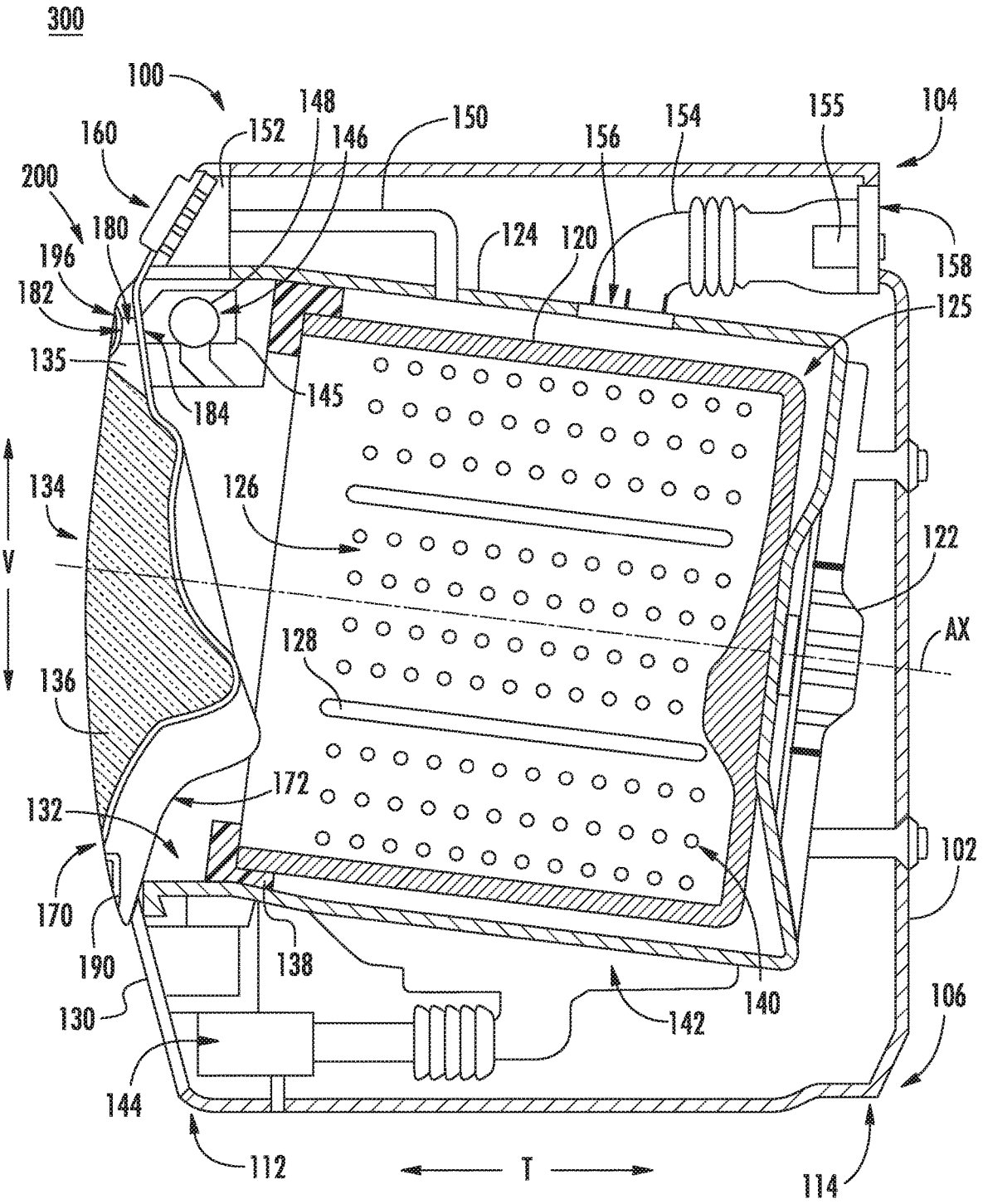
FIG. 2 provides a cross-sectional side view of the washing machine appliance of FIG. 1.

FIGS. 1 and 2 provide views of an example horizontal axis washing machine appliance 100. Particularly, FIG. 1 provides a front view of horizontal axis washing machine appliance 100 and FIG. 2 provides a side cross-sectional view thereof. As illustrated, washing machine appliance 100 defines a vertical direction V, a lateral direction L (FIG. 1), and a transverse direction T (FIG. 2), each of which is mutually perpendicular such that an orthogonal coordinate system is defined. Washing machine appliance 100 includes a cabinet 102 that extends between a top 104 and a bottom 106 along the vertical direction V, between a left side 108 and a right side 110 along the lateral direction L (FIG. 1), and between a front 112 and a back 114 along the transverse direction T (FIG. 2).

As best shown in FIG. 2, a wash tub 124 is positioned within cabinet 102 and is generally configured for retaining wash fluids during an operating cycle. As used herein, "wash fluid" may refer to water, detergent, fabric softener, bleach, or any other suitable wash additive or combination thereof. Wash tub 124 is substantially fixed relative to cabinet 102 such that it does not rotate or translate relative to cabinet 102. Wash tub 124 defines an interior volume 125. A drum or wash basket 120 is received within wash tub 124 and defines a wash chamber 126 configured for receipt of articles for washing. More specifically, wash basket 120 is rotatably mounted within interior volume 125 of wash tub 124 such that it is rotatable about an axis of rotation AX. For this embodiment, the axis of rotation AX is substantially parallel to the transverse direction T. In this regard, washing machine appliance 100 is generally referred to as a "horizontal axis" or "front load" washing machine appliance 100.

Wash basket 120 can define one or more agitator features that extend into wash chamber 126 to assist in agitation and cleaning articles disposed within wash chamber 126 during operation of washing machine appliance 100. For this embodiment, ribs 128 extend from wash basket 120 into wash chamber 126. In this manner, the ribs 128 can lift or otherwise move articles disposed in wash basket 120 during rotation of wash basket 120. Wash basket 120 and wash tub 124 collectively form a subwasher of washing machine appliance 100.

In addition, washing machine appliance 100 includes a motor assembly 122 that is in mechanical communication with wash basket 120 to selectively rotate wash basket 120 about the axis of rotation AX (e.g., during an agitation or a rinse cycle of washing machine appliance 100). For this embodiment, motor assembly 122 is a pancake motor. However, in some embodiments, motor assembly 122 can be any suitable type, size, or configuration that is operable to rotate wash basket 120.

As further shown in FIGS. 1 and 2, cabinet 102 includes a front panel 130 that defines an opening 132 (FIG. 2) that permits user access to wash basket 120. More specifically, washing machine appliance 100 includes a door 134 that is operatively coupled with cabinet 102. Particularly, door 134 is rotatably mounted to front panel 130 (e.g., about a hinge axis that is substantially parallel to the vertical direction V). In this manner, door 134 permits selective access to opening 132 by being movable between an open position (not shown) facilitating access to wash basket 120 and a closed position (FIGS. 1 and 2) prohibiting access to wash basket 120. In the closed position, door 134 is positioned over opening 132.

A window 136 in door 134 permits viewing of wash basket 120 when door 134 is in the closed position (e.g., during operation of washing machine appliance 100). Door 134 also includes a handle that a user may pull when opening and closing door 134. Further, although door 134 is illustrated as mounted to front panel 130, it should be appreciated that door 134 may be mounted to another side of cabinet 102 or any other suitable support structure in alternative embodiments. One or more gaskets 138 can seal tub 124 relative to cabinet 102 and door 134 relative to front panel 130.

With reference to FIG. 2, wash basket 120 defines a plurality of perforations 140 in order to facilitate fluid communication between basket 120 and wash tub 124. A sump 142 is positioned below wash tub 124 along the vertical direction V. Sump 142 is configured for receipt of, and generally collects, wash fluid during operation of washing machine appliance 100. For example, during operation of washing machine appliance 100, wash fluid may be urged (e.g., by gravity) from basket 120 to sump 142 through the plurality of perforations 140. A pump assembly 144 is located beneath wash tub 124 for gravity assisted flow when draining wash tub 124. Pump assembly 144 can also be configured for recirculating wash fluid within wash tub 124.

Wash basket 120, wash tub 124, and motor assembly 122 can be supported by a vibration damping system. The damping system is operable to damp or reduce dynamic motion as wash basket 120 rotates within tub 124. The damping system can include one or more damper assemblies coupled between and to the cabinet 102 and wash tub 124 (e.g., at a bottom portion of wash tub 124). For instance, four damper assemblies can be utilized. The damper assemblies can be spaced apart about wash tub 124. For example, each damper assembly can be connected at one end proximate to a bottom corner of cabinet 102. Additionally or alternatively, the washer can include other vibration damping elements, such as one or more suspension assemblies positioned above basket 120 and attached to tub 124 at a top portion thereof.

As further depicted in FIGS. 1 and 2, for this embodiment, washing machine appliance 100 includes an additive dispenser or spout 150 (FIG. 2). For example, spout 150 may be in fluid communication with a water supply (not shown) in order to direct fluid (e.g., clean water) into wash tub 124. Spout 150 may also be in fluid communication with sump 142. For example, pump assembly 144 can direct wash fluid disposed in sump 142 to spout 150 in order to circulate wash fluid in wash tub 124. A detergent drawer 152 is slidably mounted within front panel 130. Detergent drawer 152 receives a wash additive (e.g., detergent, fabric softener, bleach, or any other suitable liquid or powder) and directs the fluid additive to wash chamber 126 during operation of washing machine appliance 100. According to the illustrated embodiment, detergent drawer 152 may also be fluidly coupled to spout 150 to facilitate the dispensing of wash additive.

As shown in FIG. 1, a control panel 160 including a plurality of input selectors 162 is coupled to front panel 130. Control panel 160 and input selectors 162 collectively form a user interface for operator selection of machine cycles and features. In some embodiments, a display 164 indicates selected features, a countdown timer, or other items of interest to machine users. Operation of washing machine appliance 100 is controlled by a controller 166 communicatively coupled with control panel 160 for user manipulation to select washing machine cycles and features. In response to user manipulation of control panel 160, e.g. to one of input selectors 162, controller 166 operates various components of washing machine appliance 100 to execute selected machine cycles and features.

Controller 166 can include a memory (e.g., non-transitory memory) and microprocessor, such as a general or special purpose microprocessor operable to execute programming instructions or micro-control code associated with a wash operation. The memory can represent random access memory such as DRAM, or read only memory such as ROM or FLASH. In some embodiments, the processor executes programming instructions stored in memory. The memory can be a separate component from the processor or can be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100, such as motor assembly 122, a fan, a damper (as discussed herein), are communicatively coupled with controller 166 via one or more signal lines, shared communication busses, or wireless links.

Washing machine appliance 100 can perform an operating cycle in the following example manner. To begin, laundry items are loaded into wash basket 120 through opening 132, and a wash operation is initiated through operator manipulation of input selectors 162 on control panel 160. For example, a wash cycle can be initiated such that wash tub 124 is filled with water, detergent, or other fluid additives (e.g., via additive dispenser 150). One or more valves (not shown) can be controlled by washing machine appliance 100 to provide for filling wash basket 120 to the appropriate level for the amount of articles being washed or rinsed. By way of example, once wash basket 120 is filled to the desired level with fluid, the contents of wash basket 120 can be agitated (e.g., with ribs 128) for an agitation phase of laundry items in wash basket 120. During the agitation phase, wash basket 120 is rotated about the axis of rotation AX at a set speed (e.g., a first speed or tumble speed). As the basket 120 is rotated, articles within the basket 120 may be lifted and permitted to drop therein.

After the agitation phase of the washing operation is completed, wash tub 124 can be drained. Laundry articles can then be rinsed (e.g., in a rinse cycle) by again adding fluid to wash tub 124, depending on the particulars of the wash cycle selected by a user. Ribs 128 may again provide agitation within wash basket 120. One or more spin cycles may also be used. In particular, a spin cycle may be applied after the wash cycle or after the rinse cycle in order to wring wash fluid from the articles being washed. During a spin cycle, basket 120 is rotated at relatively high speeds about the axis of rotation AX. After articles disposed in wash basket 120 are cleaned (or the washing operation otherwise ends), a user can remove the articles from wash basket 120 (e.g., by opening door 134 and reaching into wash basket 120 through opening 132).

In some instances, after an operating cycle has been completed, residual water and/or wash fluid can remain within the interior volume 125 of wash tub 124 as well as on various components and surfaces of washing machine appliance 100. For instance, water and/or wash fluid can remain on one or more gaskets, within sump 142, or generally within wash basket 120 and wash tub 124. As noted previously, such residual water and/or wash fluid can produce mold and mildew if left unaddressed, which may result in an undesirable odor. Further, over time, mold/mildew can buildup and generate black spots on articles, especially white clothes. In accordance with example aspects of the present subject matter, washing machine appliance 100 includes a venting system 200 (FIG. 2) operable to passively and/or actively circulate fresh air into the interior volume 125 of wash tub 124 to reduce the humidity therein, thereby reducing the risk of mold/mildew and the resultant odor.

Figure 3:
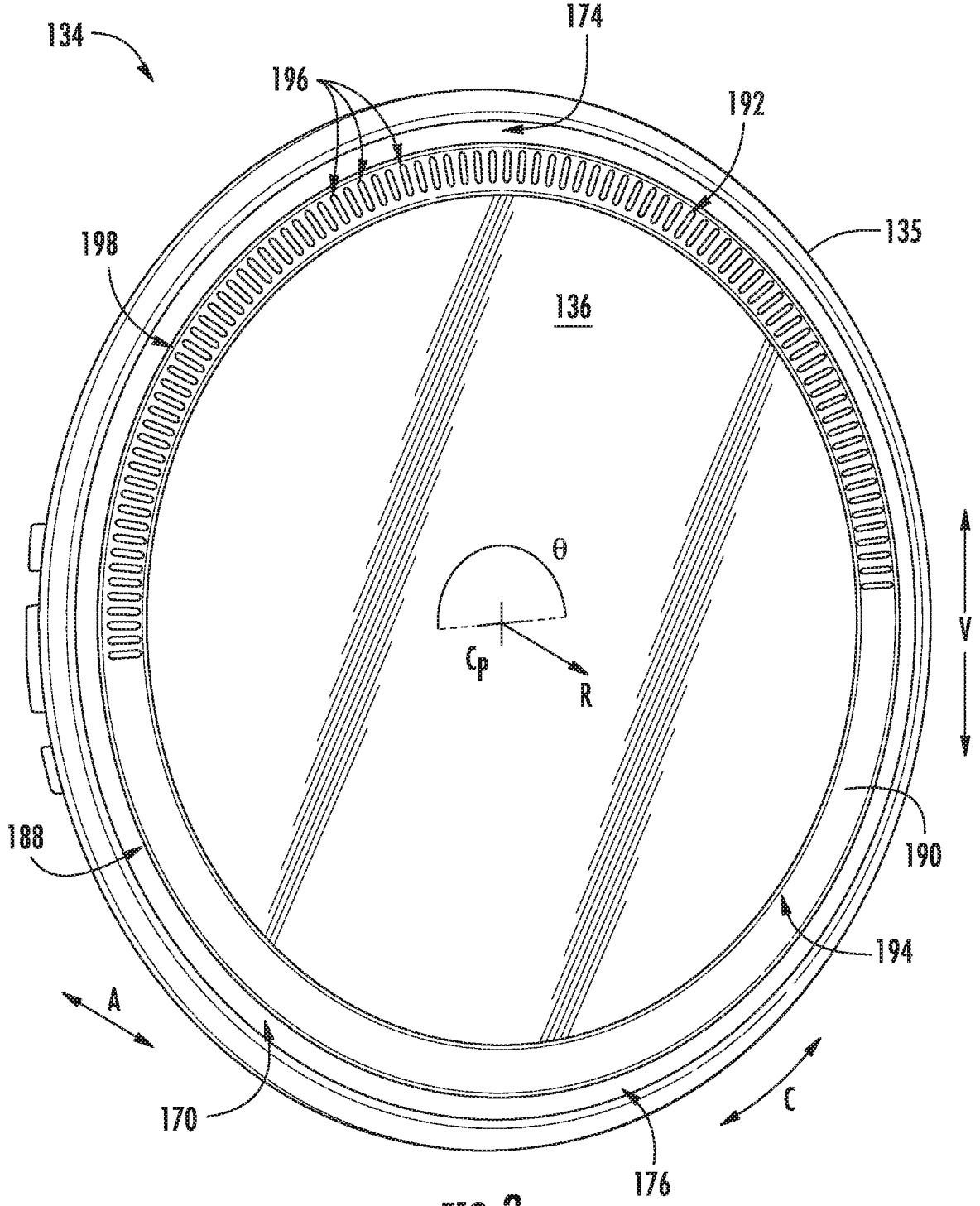
FIG. 3 provides a front perspective view of a door of the washing machine appliance of FIG. 1.
Figure 4:
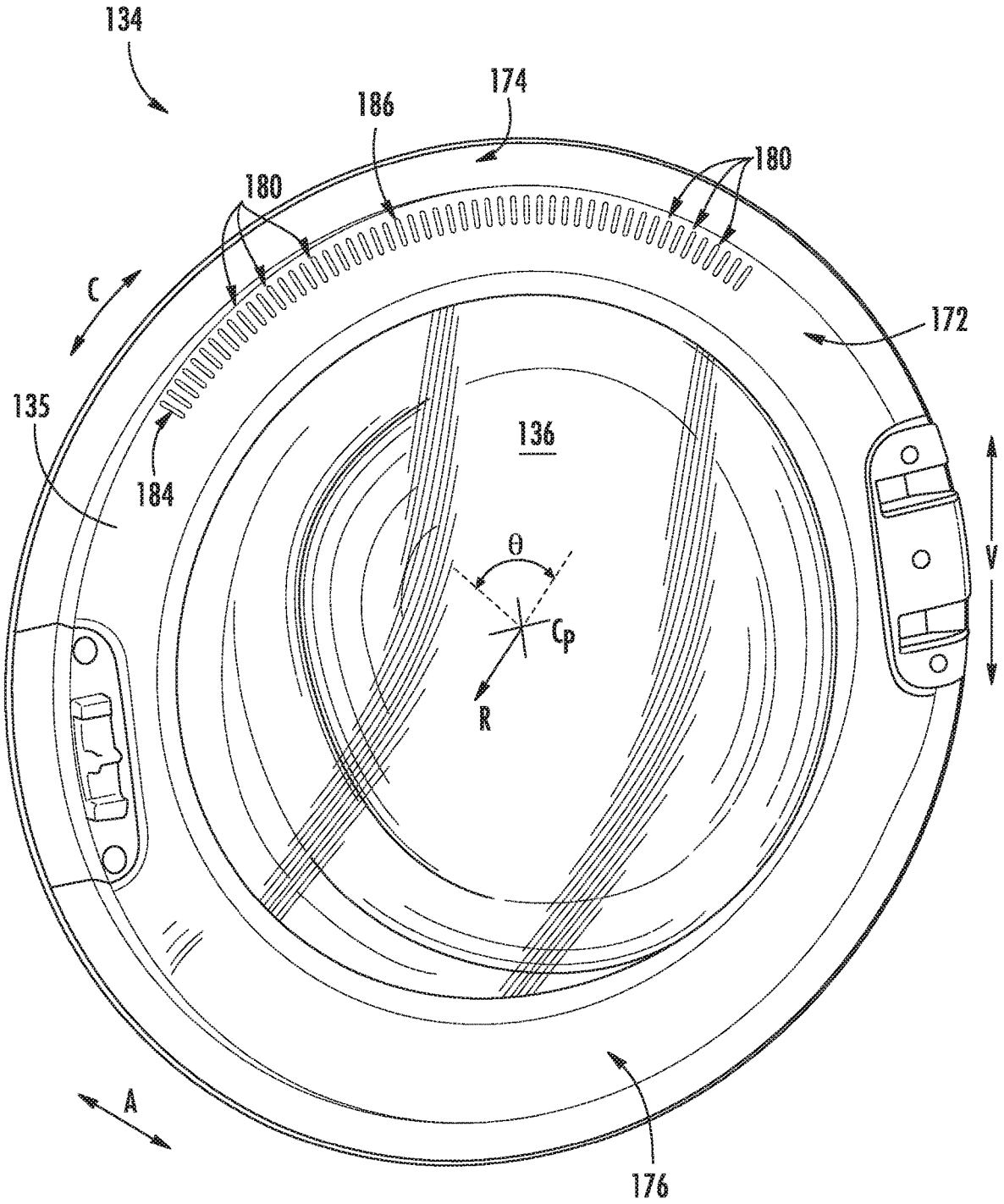
FIG. 4 provides a rear perspective view of the door of the washing machine appliance of FIG. 1.

With general reference now to FIGS. 1, 2, 3, and 4, venting system 200 will now be described. FIG. 3 provides a front perspective view of door 134 of washing machine appliance 100 and FIG. 4 provides a rear perspective view of door 134 of washing machine appliance 100. Generally, fresh air from an ambient environment 300 (FIG. 2) can enter washing machine appliance 100 through one or more features of door 134. The fresh air can flow through the features of door 134 and into the interior volume 125 of wash tub 124. The relatively low humidity fresh air can displace the relatively humid air within wash tub 124 (e.g., after a wash cycle) and cause the humid air to exhaust or otherwise exit washing machine appliance 100. In this way, the overall humidity level within wash tub 124 can be reduced, which as noted previously, can reduce the risk of mold/mildew from forming on various components and surfaces of washing machine appliance 100.

For this embodiment, as shown best in FIGS. 3 and 4, door 134 has a circular shape. For reference, door 134 defines a center point CP. Further, door 134 defines an axial direction A, a radial direction R, and a circumferential direction C. When door 134 is in the closed position (as shown in FIGS. 1 and 2), the axial direction A extends parallel with the transverse direction T. The radial direction R extends orthogonal to the axial direction A inward toward the center point CP and orthogonal to the axial direction A outward away from the center point CP. The circumferential direction C extends three hundred sixty degrees (360°) around the center point CP in a direction orthogonal to the axial direction A. In other embodiments, door 134 can have other suitable shapes and configurations.

Door 134 has a door frame 135. Door frame 135 can be formed of plastic or another suitable material. Door frame 135 has a front side 170 (FIG. 3) and a back side 172 (FIG. 4). When door 134 is in the closed position (FIGS. 1 and 2), front side 170 faces outward toward the ambient environment 300 (FIG. 2) and the back side 172 faces inward toward the interior volume 125 of wash tub 124 (FIG. 2). Further, door frame 135 has an upper portion 174 and a lower portion 176. The upper portion 174 is positioned above lower portion 176 along the vertical direction V. For this embodiment, door frame 135 extends annularly around and retains window 136. Thus, door frame 135 is annular or ring-shaped. Accordingly, for this embodiment, the upper portion 174 forms an upper arc of door frame 135 and the lower portion 176 forms a lower arc of door frame 135. The upper portion 174 and the lower portion 176 can be separated by a reference plane that is orthogonal to the vertical direction V and positioned midway between the top of door frame 135 and the bottom of door frame 135. Thus, upper portion 174 can form the upper half of door frame 135 and lower portion 176 can form the lower half of door frame 135.

Notably, as shown best in FIGS. 2 and 4, door frame 135 defines a plurality of vent apertures 180 (only one vent aperture is shown in FIG. 2). The vent apertures 180 provide fluid communication between the ambient environment 300 surrounding washing machine appliance 100 and the interior volume 125 of wash tub 124 when door 134 is in the closed position. Accordingly, fresh air having relatively low humidity can flow into interior volume 125 to effectively reduce the humidity level within interior volume 125. As depicted in FIG. 2, the vent apertures 180 extend from front side 170 to back side 172 of door frame 135; thus, the vent apertures extend through door frame 135. For this embodiment, the vent apertures 180 are not sealed when door 134 is in the closed position.

As depicted, the plurality of vent apertures 180 are defined at the upper portion 174 of door frame 135 and are spaced from one another along the circumferential direction C. The plurality of vent apertures 180 are each defined as elongated, oval-shaped apertures. The vent apertures 180 extend longitudinally or lengthwise along the radial direction R. Moreover, the plurality of vent apertures 180 are defined by door frame 135 in an arc arrangement or along an arc 186, or more particularly, in a circular arc arrangement as shown best in FIG. 4. For this embodiment, the plurality of vent apertures 180 include at least ten (10) vent apertures. Particularly, for this embodiment, plurality of vent apertures 180 include at least fifty (50) vent apertures defined at upper portion 174 of door frame 135 along arc 186. As shown best in FIG. 4, the arc central angle θ of arc 186 measures equal to or greater than thirty degrees (30°). In this example, for instance, the arc central angle θ of arc 186 measures about sixty degrees (60°).

Figure 5:
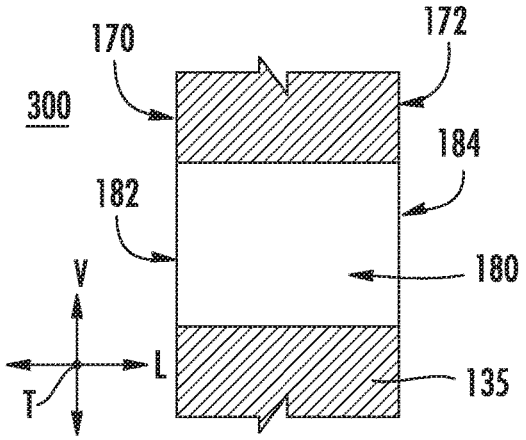
FIG. 5 provides a close up, cross-sectional view of one embodiment of a door frame of the door of the washing machine appliance of FIG. 1.
Figure 6:
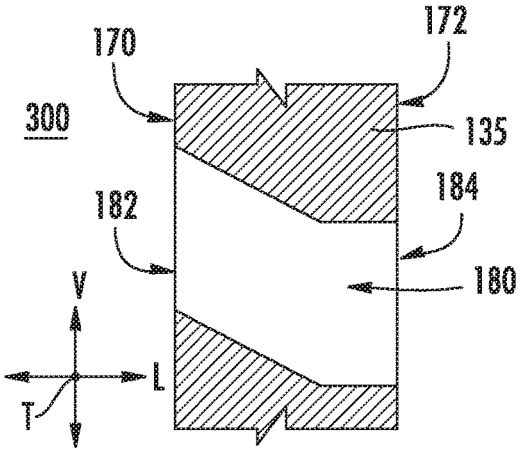
FIG. 6 provides a close up, cross-sectional view of another embodiment of a door frame of the door of the washing machine appliance of FIG. 1.
Figure 7:
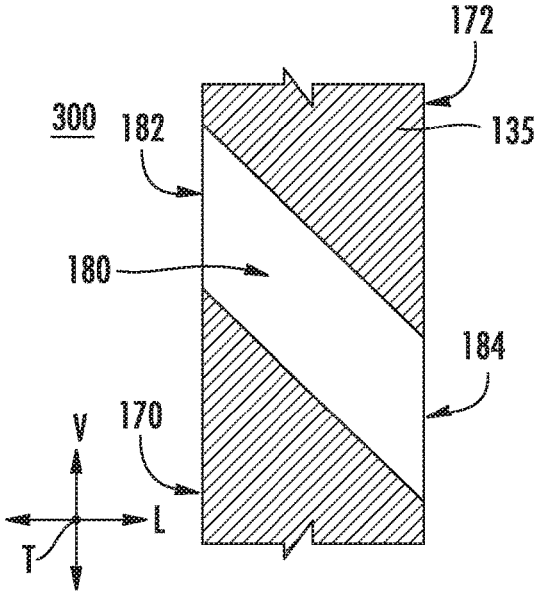
FIG. 7 provides a close up, cross-sectional view of yet another embodiment of a door frame of the door of the washing machine appliance of FIG. 1.

Each vent aperture 180 has a first end or inlet 182 (e.g., at front side 170 of door frame 135) and a second end or outlet 184 (e.g., at back side 172 of door frame 135) as shown in FIG. 2. In some embodiments as shown in FIG. 5, for one or more of the vent apertures 180, the inlet 182 and the outlet 184 of one or more vent apertures 180 are aligned with one another. That is, the inlet 182 and outlet 184 are completely aligned with one another along the lateral direction L and vertical direction V. In yet other embodiments as shown in FIG. 6, for one or more of the vent apertures 180, the inlet 182 and the outlet 184 are offset from one another. For instance, the outlet 184 of a given vent aperture 180 can be offset from the inlet 182 along the vertical direction V, along the lateral direction L, or a combination thereof. By offsetting the inlet 182 from the outlet 184, fresh air can flow from the ambient environment 300 into the interior volume 125 of wash tub 124 (FIG. 2) whilst liquid within wash tub 124 is impeded or prevented from splashing or flowing out of wash tub 124, e.g., during a wash or rinse cycle. In some embodiments as shown in FIG. 7, the inlet 182 of a given vent aperture 180 is completely offset from the outlet 184. That is, no part of the inlet 182 overlaps or aligns with the outlet 184 along the vertical direction V or lateral direction L. For instance, as depicted in FIG. 7, the outlet 184 can be located completely below the inlet 182 along the vertical direction V, e.g., to create a tortuous path between the inlet 182 and outlet 184. In yet other embodiments, the inlet 182 and the outlet 184 of one or more vent apertures 180 can be partially offset. That is, the inlet 182 can be aligned at least in part with the outlet 184 along the vertical direction V and/or lateral direction L, e.g., as shown in FIG. 6.

With reference again to FIGS. 1 and 3, for this embodiment, door frame 135 defines a recess 188 (FIG. 3) at the front side 170. For this embodiment, the recess 188 is an annular recess. The depth of the recess 188 extends along the transverse direction T (or axial direction A). A venting grill 190 is received within the recess 188 defined by door frame 135 at front side 170. Venting grill 190 is ring-shaped and sized complementary to recess 188 such that venting grill 190 can be received therein. The venting grill 190 can be coupled with door frame 135 in any suitable manner. For instance, venting grill 190 can be snap fit into recess and secured in place within one or more retention members, mechanical fasteners, or some combination thereof. In some alternative embodiments, washing machine appliance 100 need not include venting grill 190 and door frame 135 need not define recess 188 in which venting grill 190 is received. In such embodiments, the inlets 182 of the vent apertures 180 defined by door frame 135 can thus be open or exposed to the ambient environment 300.

As depicted best in FIG. 3, venting grill 190 has an upper portion 192 and a lower portion 194. The upper portion 192 is positioned above lower portion 194 along the vertical direction V. For this embodiment, the upper portion 192 forms an upper arc of venting grill 190 and the lower portion 194 forms a lower arc of venting grill 190. The upper portion 192 and the lower portion 194 can be separated by a reference plane that is orthogonal to the vertical direction V and positioned midway between the top of venting grill 190 and the bottom of venting grill 190.

Notably, as shown in FIGS. 1 through 3, venting grill 190 defines a plurality of grill apertures 196 that provide fluid communication between the ambient environment 300 (FIG. 2) and the plurality of vent apertures 180 defined by door frame 135. The grill apertures 196 defined by venting grill 190 are similarly shaped and sized as the vent apertures 180 defined by door frame 135; however, the grill apertures can have other suitable shapes and sizes. For this embodiment, the grill apertures 196 are defined at the upper portion 192 of venting grill 190 and are spaced from one another along the circumferential direction C. In the depicted embodiment, venting grill 190 does not define any grill apertures 196 at lower portion 194 of venting grill 190. The plurality of grill apertures 196 are each defined as elongated, oval-shaped apertures. The grill apertures 196 extend longitudinally or lengthwise along the radial direction R. Moreover, the plurality of grill apertures 196 are defined by venting grill 190 in an arc arrangement or along an arc 198, or more particularly, in a circular arc arrangement. Moreover, for this embodiment, the plurality of grill apertures 196 include at least ten (10) grill apertures. Specifically, for this embodiment, the plurality of grill apertures 196 include at least eighty (80) grill apertures defined at upper portion 192 of venting grill 190. As shown best in FIG. 3, the arc central angle θ of arc 198 measures equal to or greater than one hundred twenty degrees (120°). In this example, for instance, the arc central angle θ of arc 198 measures about one hundred eighty degrees (180°).

For this embodiment, the venting grill 190 defines more grill apertures 196 than door frame 135 defines vent apertures 180. That is, in this example embodiment, there are more grill apertures 196 than vent apertures 180. For instance, in some embodiments, door frame 135 defines about fifty (50) vent apertures 180 along arc 186 measuring about sixty degrees (60°) relative to the central angle θ of door 134 as shown in FIG. 4 and venting grill 190 defines more than eighty (80) grill apertures 196 along arc 198 measuring about one hundred eighty degrees (180°) relative to the central angle θ of door 134. By including more grill apertures 196 than vent apertures 180, enhanced airflow through the vent apertures 180 can be achieved. That is, fresh air from ambient environment 300 can flow through the grill apertures 196, along the recess 188, and into the vent apertures 180. In this way, the venting grill 190 can facilitate airflow to the vent apertures 180. In other embodiments, the venting grill 190 defines the same number of grill apertures 196 as door frame 135 defines vent apertures 180.

In further embodiments, the venting grill 190 defines less grill apertures 196 than door frame 135 defines vent apertures 180.

In some embodiments, the grill apertures 196 can be aligned with the inlets 182 of the vent apertures 180. For instance, each vent aperture 180 can have a corresponding grill aperture 196 and the apertures can be aligned along the lateral direction L and vertical direction V. In yet other embodiments, the grill apertures 196 can be offset from the inlets 182 of the vent apertures 180, e.g., along the vertical direction V, the lateral direction L, or some combination thereof.

As further shown in FIG. 2, for this embodiment, washing machine appliance 100 includes a damper 148. Damper 148 is positioned within a chamber 146 defined by a damper housing 145. The chamber 146 provides fluid communication between the outlets 184 of the vent apertures 180 and the interior volume 125 of wash tub 124. Damper 148 is operable to regulate the fluid flow through chamber 146. Particularly, damper 148 is movable between a first or open position in which fluid (e.g., air) is permitted to flow through chamber 146 and a second or closed position in which fluid is prevented from flowing through chamber 146. A motor mechanically coupled with damper 148 can be communicatively coupled with controller 166 (FIG. 1). For instance, controller 166 can send one or more command signals to the motor. The commands signals can be received by the motor of the damper 148 and can be indicative of instructions for actuating the damper 148, e.g., to the closed or open position. Thus, controller 166 can cause damper 148 to actuate or move between the open and closed positions. Consequently, damper 148 can regulate the mass flow from the ambient environment 300 into the interior volume 125 of wash tub 124.

In some alternative embodiments, fresh air from ambient environment 300 can flow through vent apertures 180 and directly into the interior volume 125 of wash tub 124. Thus, in some embodiments, washing machine appliance 100 need not include damper housing 145, chamber 146, or damper 148.

As further depicted in FIG. 2, washing machine appliance 100 includes various features for exhausting the relative humid air from the interior volume 125 of wash tub 124. Particularly, as depicted, washing machine appliance 100 includes a venting conduit 154 that provides fluid communication between the interior volume 125 of wash tub 124 and the ambient environment 300. Venting conduit 154 has an inlet 156 and an outlet 158. The inlet 156 of venting conduit 154 receives relatively humid air from the interior volume 125 of wash tub 124. The relatively humid air can be vented or expelled from venting conduit 154 through outlet 158. The outlet 158 of venting conduit 154 is positioned at the back 114 of cabinet 102 and the inlet 156 of venting conduit 154 is in fluid communication with the interior volume 125 at a top portion of tub 124 in this embodiment.

In some example embodiments, to actively move or force the relatively humid air from the interior volume 125 of wash tub 124, washing machine appliance 100 includes a fan 155. As shown in FIG. 2, fan 155 is positioned along venting conduit 154. Fan 155 is operable to move air from the interior volume 125 of wash tub 124 to the ambient environment 300. Fan 155 can be activated by controller 166. For instance, controller 166 can send an activation signal to a motor of fan 155 to cause one or more blades of fan 155 to rotate, e.g., upon the completion of a wash cycle. Controller 166 can send a deactivation signal to the motor of fan 155 to cause the one or more blades of fan 155 to cease rotation, e.g., after a predetermined time has elapsed. In yet other embodiments, the relatively humid air within interior volume 125 can be displaced therefrom by other means, such as e.g., by pump water displacement or some other suitable method or means.

Figure 8:
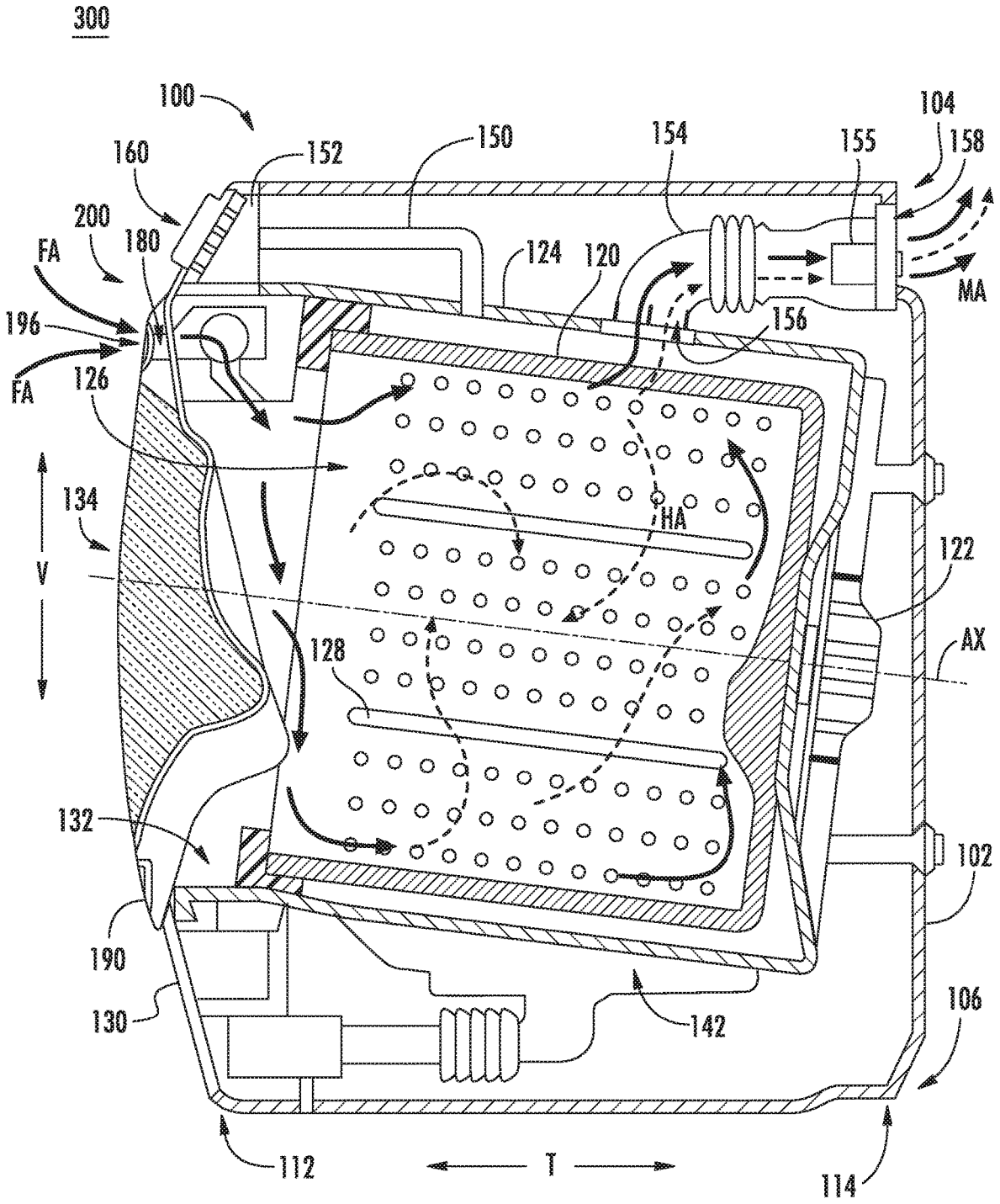
FIG. 8 provides another cross sectional side view of the washing machine appliance of FIG. 1 depicting fluid flow through a venting system of the washing machine appliance.

With reference now to FIG. 8, an example manner in which venting system 200 can actively vent or displace relatively humid air from the interior volume 125 of wash tub 124 will now be described. After completion of a wash cycle or at another suitable time, controller 166 (FIG. 1) can send an activation signal to a motor of fan 155 to cause fan 155 to rotate. When this occurs, relatively low humidity fresh air FA from ambient environment 300 is moved through door 134. Particularly, fresh air FA is moved through the plurality of grill apertures 196 defined by venting grill 190 and through the plurality of vent apertures 180 defined by door frame 135. The received fresh air FA can continue through chamber 146. Controller 166 can also send one or more command signals to the motor of damper 148 to actuate damper 148 to the open position. In this way, the fresh air FA moving through door 134 can be moved through chamber 146 and into the interior volume 125 of wash tub 124.

The fresh air FA mixes with the relatively humid air HA within the interior volume 125. Some of the mixed air MA is vented from interior volume 125 via venting conduit 154. Specifically, some mixed air MA enters the inlet 156 of venting conduit 154 as depicted in FIG. 8 and flows through or along venting conduit 154 toward outlet 158. Fan 155 moves the mixed air MA through venting conduit 154 and expels or vents the mixed air MA from washing machine appliance 100 through outlet 158. After a predetermined time and/or upon reaching a predetermined humidity level within interior volume 125 (e.g., as sensed by a humidity sensor), controller 166 can send a deactivation signal to the motor of fan 155 to cause fan 155 to cease rotation.

With reference still to FIG. 8, an example manner in which venting system 200 can passively vent or displace relatively humid air from the interior volume 125 of wash tub 124 will now be described. After completion of a wash cycle or at another suitable time, relatively low humidity fresh air FA from ambient environment 300 can flow passively through door 134. Particularly, fresh air FA can flow through the plurality of grill apertures 196 defined by venting grill 190 and through the plurality of vent apertures 180 defined by door frame 135. The received fresh air FA can continue into the interior volume 125 of wash tub 124 (through chamber 146 if included in washing machine appliance 100). The fresh air FA mixes with the relatively humid air HA within the interior volume 125 as shown in FIG. 8. Some of the mixed air MA can flow into venting conduit 154. Specifically, some mixed air MA enters the inlet 156 of venting conduit 154 as depicted in FIG. 8 and flows through or along venting conduit 154 toward outlet 158. The mixed air MA exits washing machine appliance 100 via outlet 158. The venting system 200 can passively vent or displace the humid air HA from the interior volume 125 until the humidity level within the interior volume 125 reaches equilibrium with the humidity level of the ambient environment 300 surrounding washing machine appliance 100.

The venting system 200 of washing machine appliance 100 described herein provides a number of advantages and benefits. For instance, venting system 200 described herein can reduce the humidity level within the interior volume 125 of wash tub 124, thereby reducing the risk of mold and mildew buildup on various surfaces and components of washing machine appliance 100, including door 134, sealing gaskets and baffles, the subwasher (i.e., the combined assembly of wash basket 120 and wash tub 124), etc. Consequently, undesirable odors emanating from mold/mildew can be reduced or eliminated. The vent apertures 180 defined by door frame 135 of door 134 allow for a mass flow of fresh air to enter the interior volume 125 and displace the relatively humid therefrom, which as noted above, reduces the risk of mold and mildew buildup.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet;

a tub positioned within the cabinet and defining an interior volume;

a basket rotatably mounted within the tub, the basket defining a wash chamber for receipt of articles for washing;

a door operatively coupled with the cabinet and movable between an open position and a closed position to provide selective access to the wash chamber, the door having a door frame defining a plurality of vent apertures that provide fluid communication between an ambient environment and the interior volume of the tub when the door is in the closed position.

2. The washing machine appliance of claim 1, wherein the door frame has an upper portion and a lower portion, and wherein the plurality of vent apertures are defined at the upper portion of the door frame.

3. The washing machine appliance of claim 1, wherein the plurality of vent apertures are arranged along an arc.

4. The washing machine appliance of claim 3, wherein the door frame has a circular shape, and wherein an arc central angle of the arc measures equal to or greater than thirty degrees (30°).

5. The washing machine appliance of claim 4, wherein the plurality of vent apertures include at least ten (10) vent apertures.

6. The washing machine appliance of claim 1, wherein the plurality of vent apertures are each elongated oval-shaped vent apertures.

7. The washing machine appliance of claim 1, wherein the door frame has a front side and a back side, and wherein the door frame defines a recess at the front side, and wherein the washing machine appliance further comprises:

a venting grill received within the recess defined by the door frame at the front side, wherein the venting grill defines a plurality of grill apertures that provide fluid communication between the ambient environment and the plurality of vent apertures.

8. The washing machine appliance of claim 7, wherein the venting grill defines more grill apertures than the door frame defines vent apertures.

9. The washing machine appliance of claim 7, wherein the recess defined by the door frame is an annular recess and the venting grill is ring-shaped.

10. The washing machine appliance of claim 1, wherein the plurality of vent apertures each have an inlet and an outlet, and wherein the inlet and the outlet of at least one of the plurality of vent apertures are offset from one another.

11. The washing machine appliance of claim 1, wherein the plurality of vent apertures each have an inlet and an outlet, and wherein the inlet and the outlet of at least one of the plurality of vent apertures are aligned with one another.

12. The washing machine appliance of claim 1, further comprising:

a venting conduit providing fluid communication between the interior volume of the tub and the ambient environment.

13. The washing machine appliance of claim 12, further comprising:

a fan positioned along the venting conduit and operable to move air from the interior volume of the tub to the ambient environment.

14. The washing machine appliance of claim 1, wherein the washing machine appliance is a horizontal axis washing machine appliance.

15. A horizontal axis washing machine appliance, comprising:

a cabinet;

a tub positioned within the cabinet and defining an interior volume;

a basket rotatably mounted within the tub, the basket defining a wash chamber for receipt of articles for washing;

a door operatively coupled with the cabinet and movable between an open position and a closed position to provide selective access to the wash chamber, the door having a door frame that has an upper portion and a lower portion, the door frame defining a recess and a plurality of vent apertures at the upper portion that extend through the door frame;

a venting grill received within the recess and defining a plurality of grill apertures; and a venting conduit in fluid communication with the interior volume of the tub and an ambient environment, and wherein when the door is in the closed position, the plurality of grill apertures provide fluid communication between the ambient environment and the plurality of vent apertures and the plurality of vent apertures provide fluid communication between the plurality of grill apertures and the interior volume of the tub.

16. The horizontal axis washing machine appliance of claim 15, wherein the plurality of vent apertures each have an inlet and an outlet, and wherein the inlet and the outlet of at least one of the plurality of vent apertures are completely offset from one another.

17. The horizontal axis washing machine appliance of claim 15, further comprising:

a damper operable to regulate fluid flow between the ambient environment and the interior volume of the tub, the damper movable between an open position and a closed position, wherein when the damper is in the closed position, the damper impedes fluid flow between the ambient environment and the interior volume of the tub, and wherein when the damper is in the open position, the damper allows fluid flow between the ambient environment and the interior volume of the tub.

18. The horizontal axis washing machine appliance of claim 15, further comprising:

a fan positioned along the venting conduit and operable to move air from the interior volume of the tub to the ambient environment; and a controller communicatively coupled with the fan, the controller configured to activate the fan until a predetermined time has elapsed or a humidity level within the interior volume has reached a predetermined humidity level.

19. A washing machine appliance, comprising:

a cabinet;

a tub positioned within the cabinet and defining an interior volume;

a basket rotatably mounted within the tub, the basket defining a wash chamber for receipt of articles for washing;

a door operatively coupled with the cabinet and movable between an open position and a closed position to provide selective access to the wash chamber, the door having a door frame defining a plurality of vent apertures that provide fluid communication between an ambient environment and the interior volume of the tub when the door is in the closed position, and wherein the plurality of vent apertures each have an inlet and an outlet, and wherein the inlet and the outlet of at least one of the plurality of vent apertures are offset from one another.

20. The washing machine appliance of claim 19, wherein the inlet of the at least one of the plurality of vent apertures is completely offset from the outlet.

* * * * *